US008448772B2

(12) United States Patent
Wind

(10) Patent No.: US 8,448,772 B2
(45) **Date of Patent: *May 28, 2013**

(54) APPARATUS AND METHOD FOR WATER BOTTLE RETURN

(75) Inventor: Patrick E. Wind, Darien, CT (US)

(73) Assignee: Zephyr Fluid Solutions, LLC, Danbury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/236,414

(22) Filed: Sep. 19, 2011

(65) Prior Publication Data

US 2012/0068585 A1 Mar. 22, 2012

Related U.S. Application Data

(60) Provisional application No. 61/384,002, filed on Sep. 17, 2010.

(51) Int. Cl.
*G07F 7/00* (2006.01)

(52) U.S. Cl.
USPC ..... 194/205; 194/211; 220/485; 220/494; 193/31 A

(58) Field of Classification Search
USPC ..... 194/205–213, 334, 335, 338; 209/635, 209/655, 698, 919, 924, 933; 241/36, 81, 241/99, 100; 356/42, 72, 73; 220/485–495
See application file for complete search history.

(56) References Cited

U.S. PATENT DOCUMENTS

| | | | |
|---|---|---|---|
| 969,879 | A | 9/1910 | Karlson |
| 1,995,779 | A | 3/1935 | Pencovic |
| 2,931,535 | A | 4/1960 | Lockwood |
| 2,954,111 | A | 9/1960 | Gerrard |
| 3,009,674 | A | 11/1961 | Ingvartsen |
| D223,956 | S | 6/1972 | Kenerson |
| 4,207,973 | A | 6/1980 | Stampleman |
| 4,532,859 | A | 8/1985 | Solordal |
| 4,573,641 | A | 3/1986 | DeWoolfson et al. |
| 4,579,216 | A | 4/1986 | DeWoolfson et al. |
| 4,784,251 | A | 11/1988 | DeWoolfson et al. |
| D307,343 | S | 4/1990 | Lauraine, Jr. et al. |
| 4,947,988 | A | 8/1990 | Schutz |
| 4,967,045 | A | 10/1990 | Keefer |
| D314,655 | S | 2/1991 | Hosmer |
| 5,028,099 | A | 7/1991 | Bertucco |
| 5,042,634 | A | 8/1991 | Gulmini |
| D324,593 | S | 3/1992 | Kouwenhoven |
| 5,121,778 | A | 6/1992 | Baker et al. |
| 5,161,661 | A | 11/1992 | Hammond |
| 5,222,531 | A | 6/1993 | Baker et al. |
| 5,295,519 | A | 3/1994 | Baker et al. |

(Continued)

FOREIGN PATENT DOCUMENTS

| | | |
|---|---|---|
| DE | 29706654 | 4/1997 |
| DE | 10240768 | 8/2002 |
| FR | 2641887 | 1/1989 |

*Primary Examiner* — Jeffrey Shapiro

(74) *Attorney, Agent, or Firm* — Cantor Colburn LLP

(57) ABSTRACT

An apparatus and method for receiving a recyclable product is disclosed herein. In one embodiment the apparatus includes: an enclosed structure defining an interior cavity; a bottle return mechanism for determining when a bottle has been received within the interior cavity; and a mechanism coupled to the bottle return mechanism, the mechanism being configured to provide an output when the bottle return mechanism has determined that a bottle has been inserted into the interior cavity.

18 Claims, 7 Drawing Sheets

U.S. PATENT DOCUMENTS

| | | | | |
|---|---|---|---|---|
| D349,997 | S | 8/1994 | Ullmann | |
| D351,697 | S | 10/1994 | Blotnick | |
| 5,355,987 | A | 10/1994 | DeWoolfson et al. | |
| 5,361,913 | A | 11/1994 | Melchionna | |
| D355,289 | S | 2/1995 | Schafer | |
| D361,039 | S | 8/1995 | Rokus | |
| 5,465,822 | A | 11/1995 | DeWoolfson et al. | |
| D377,553 | S | 1/1997 | Cozart | |
| 5,630,493 | A | 5/1997 | DeWoolfson et al. | |
| 5,695,039 | A | 12/1997 | Driscoll et al. | |
| D388,922 | S | 1/1998 | Peters | |
| 5,737,903 | A | 4/1998 | Minutillo | |
| D402,037 | S | 12/1998 | Hofstad | |
| D420,479 | S | 2/2000 | Delmerico | |
| 6,047,843 | A | 4/2000 | Mecke | |
| D428,229 | S | 7/2000 | Olivetti | |
| D434,449 | S | 11/2000 | Tandberg | |
| D441,023 | S | 4/2001 | Vaajakallio | |
| 6,223,927 | B1 | 5/2001 | Rand | |
| 6,299,061 | B1 | 10/2001 | Henson | |
| 6,349,972 | B1 | 2/2002 | Geiger et al. | |
| 6,547,055 | B2 | 4/2003 | Coyne et al. | |
| 6,578,763 | B1 | 6/2003 | Brown | |
| 6,817,462 | B1 | 11/2004 | Salda | |
| D541,870 | S | 5/2007 | Tandberg | |
| D542,495 | S | 5/2007 | Boydston et al. | |
| D549,418 | S | 8/2007 | Boydston et al. | |
| 7,296,745 | B2 | 11/2007 | Weisz et al. | |
| D565,268 | S | 3/2008 | Boydston et al. | |
| D566,920 | S | 4/2008 | Boydston et al. | |
| 7,921,979 | B2 * | 4/2011 | Kreitz et al. | 194/211 |
| 8,109,378 | B2 * | 2/2012 | Boydston et al. | 194/205 |
| 2003/0042110 | A1 | 3/2003 | Wilfong | |
| 2005/0073417 | A1 | 4/2005 | Matthewson, II et al. | |
| 2006/0065717 | A1 | 3/2006 | Hurwitz et al. | |
| 2006/0069642 | A1 | 3/2006 | Doran et al. | |
| 2006/0071063 | A1 | 4/2006 | Duckett | |
| 2007/0012541 | A1 * | 1/2007 | Boydston et al. | 194/205 |
| 2007/0090938 | A1 | 4/2007 | Donaldson | |
| 2007/0159308 | A1 | 7/2007 | Johnston | |
| 2008/0106089 | A1 | 5/2008 | Geiger et al. | |
| 2008/0121492 | A1 * | 5/2008 | Kreitz et al. | 194/205 |
| 2008/0308383 | A1 * | 12/2008 | Boydston et al. | 194/205 |
| 2009/0166149 | A1 * | 7/2009 | Horniak | 193/31 R |
| 2011/0114440 | A1 * | 5/2011 | Horniak et al. | 194/205 |
| 2012/0068584 | A1 * | 3/2012 | Wind | 312/211 |

* cited by examiner

APPARATUS AND METHOD FOR WATER BOTTLE RETURN

CROSS REFERENCE TO RELATED APPLICATIONS

This application claims the benefit of U.S. Provisional Patent Application Ser. No. 61/384,002 filed Sep. 17, 2010, the contents of which are incorporated herein by reference thereto.

BACKGROUND

This application relates to methods for vending retail products to consumers, and more specifically to a method for vending and returning recyclable water bottles.

Recently consumers have been purchasing large sized (e.g., 5 gallon, 3 gallon or equivalently sized) water bottles for use in home or other applications in addition to those traditionally used in commercial environments wherein a delivery truck arrives periodically to collect the empty bottles while supplying a fresh supply of filled water bottles. In these applications and since it is not economically feasible for scheduled deliveries from a delivery truck, the consumer is typically purchasing one or two bottles at a time from a store while at the same time returning their empty bottles.

Accordingly, it is desirable to provide a system and a method for returning empty water bottles in a quick and efficient manner.

SUMMARY

Exemplary embodiments of the present invention relate to an apparatus and method for receiving a recyclable product. In one embodiment the apparatus includes: an enclosed structure defining an interior cavity; a bottle return mechanism for determining when a bottle has been received within the interior cavity; and a mechanism coupled to the bottle return mechanism, the mechanism being configured to provide an output when the bottle return mechanism has determined that a bottle has been inserted into the interior cavity.

In another exemplary embodiment, the bottle return mechanism has: an elongated cylinder providing a passage into the interior cavity, the elongated cylinder having an inlet opening proximate to an exterior of the enclosed structure and an outlet opening proximate to the interior cavity; a first plurality of actuating arms located in the passage, wherein the first plurality of actuating arms are pivotally secured to the elongated cylinder for movement between a first position wherein a distal end of each of the plurality of actuating arms is positioned away from a surface of the elongated cylinder and a second position wherein the distal end of each of the plurality of actuating arms is moved towards the surface of the elongated cylinder, the first plurality of actuating arms being located a first distance from the inlet opening; and a second plurality of actuating arms located in the passage, wherein the second plurality of actuating arms are pivotally secured to the elongated cylinder for movement between a first position wherein a distal end of each of the plurality of actuating arms is positioned away from a surface of the elongated cylinder and a second position wherein the distal end of each of the plurality of actuating arms is moved towards the surface of the elongated cylinder, the second plurality of actuating arms being located a second distance from the inlet opening, the second distance being greater than the first distance.

In another exemplary embodiment, an apparatus for receiving recyclable product is provided, the apparatus having: an enclosed structure defining an interior cavity; and a bottle return mechanism for determining when a bottle has been received within the interior cavity. The bottle return mechanism including: an elongated cylinder providing a passage into the interior cavity, the elongated cylinder having an inlet opening proximate to an exterior of the enclosed structure and an outlet opening proximate to the interior cavity; a flexible member located proximate to the inlet opening of the elongated cylinder, the flexible member being configured to be deflected inwardly towards a surface of the elongated cylinder from a first position wherein a distal end of the flexible member is positioned in the inlet opening, wherein the flexible member is biased towards the first position and is configured to cover a portion of the inlet opening when it is in the first position such that the distal end will prevent a bottle completely inserted into the elongated cylinder through the inlet opening in a first direction from being subsequently removed from the elongated cylinder in a direction opposite to the first direction.

In still another exemplary embodiment, a method for recycling a water bottle is provided, the method including the steps of: inserting the water bottle into a bottle return mechanism of an enclosed structure, the bottle return mechanism being configured to determine when a bottle has been received within the enclosed structure; providing a first signal to another mechanism when a first plurality of actuating arms located in an elongated cylinder providing a passage into the enclosed structure are moved from a first position wherein a distal end of each of the first plurality of actuating arms is positioned away from a surface of the elongated cylinder to a second position wherein the distal end of each of the first plurality of actuating arms is moved towards the surface of the elongated cylinder; providing a second signal to the another mechanism when a second plurality of actuating arms located in the elongated cylinder are moved from a first position wherein a distal end of each of the second plurality of actuating arms is positioned away from the surface of the elongated cylinder to a second position wherein the distal end of each of the second plurality of actuating arms are moved towards the surface of the elongated cylinder, the elongated cylinder having an inlet opening proximate to an exterior of the enclosed structure and an outlet opening proximate to an interior cavity of the enclosed structure, the first plurality of actuating arms being located a first distance from the inlet opening and the second plurality of actuating arms are located a second distance from the inlet opening, the second distance being greater than the first distance; and providing an output from the another mechanism when the first signal and the second signal have been simultaneously received by the another mechanism.

DETAILED DESCRIPTION OF EXEMPLARY EMBODIMENTS

Figure 1A:
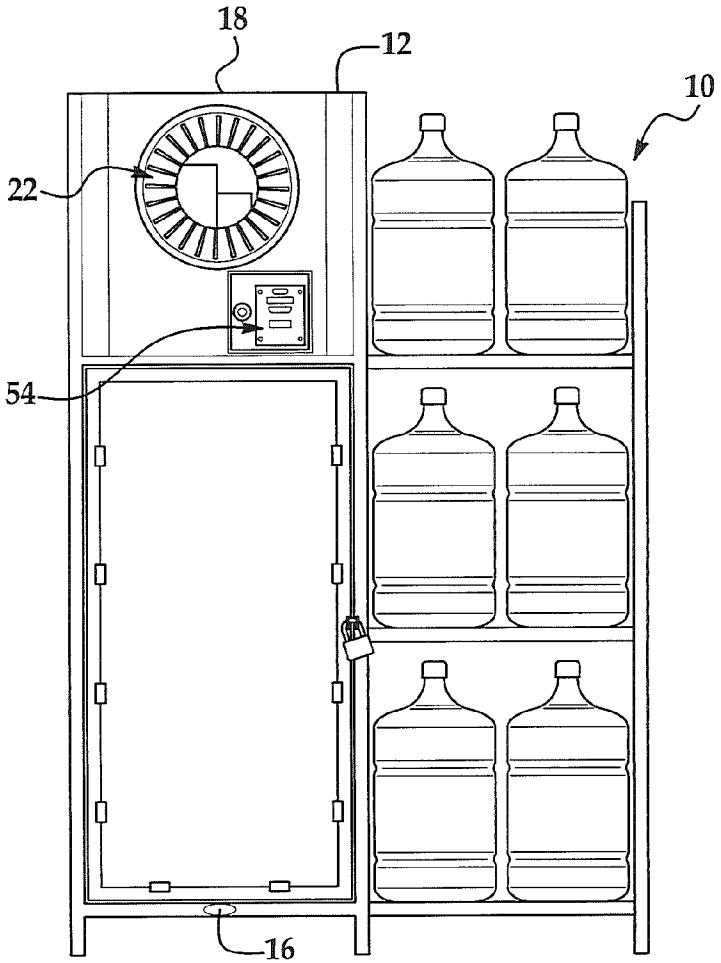
FIG. 1 is a perspective view of an exemplary bottle return apparatus in accordance with an exemplary embodiment of the present invention.

Exemplary embodiments of the present invention relate to a method and apparatus for drinking water bottles in particular, large scale models such as 5 gallon or 3 gallon varieties. Of course, other bottle sizes greater or smaller than the 5 gallon or 3 gallon size are considered to be within the scope of exemplary embodiments of the present invention.

Referring now to the FIGS. a bottle return apparatus 10 is illustrated. Bottle return apparatus 10 has a bin or enclosure 12 that is capable of holding a plurality of empty drinking water bottles for example, the aforementioned 5 gallon or 3 gallon variety. Of course, the configuration and/or size of the enclosure may vary based upon the type of empty bottles being returned, the frequency thereof, and the storage capacity of the location of the bottle return apparatus.

As illustrated, the enclosure will have a plurality of walls 14, a bottom 16 and, if necessary, a top portion 18. The enclosure including the top, bottom and walls may be configured out of any suitable material capable of withstanding repeated use and, if applicable, the elements. In one non-limiting exemplary embodiment the enclosure will resemble a cage like structure wherein the bars of the enclosure are sufficiently spaced such that any of the returned bottles will not pass therethrough.

In order to empty the enclosure after it has been filled with a plurality of empty bottles, a door 17 is located on one of the walls or alternatively one of the walls is pivotally secured to another one of the walls such that it may act as a door 17. Once the door 17 is opened the empty bottles may be retrieved from an interior cavity of the enclosure. In one embodiment, the door 17 is capable of being locked such that only authorized users are able to empty the enclosure.

Figure 1:
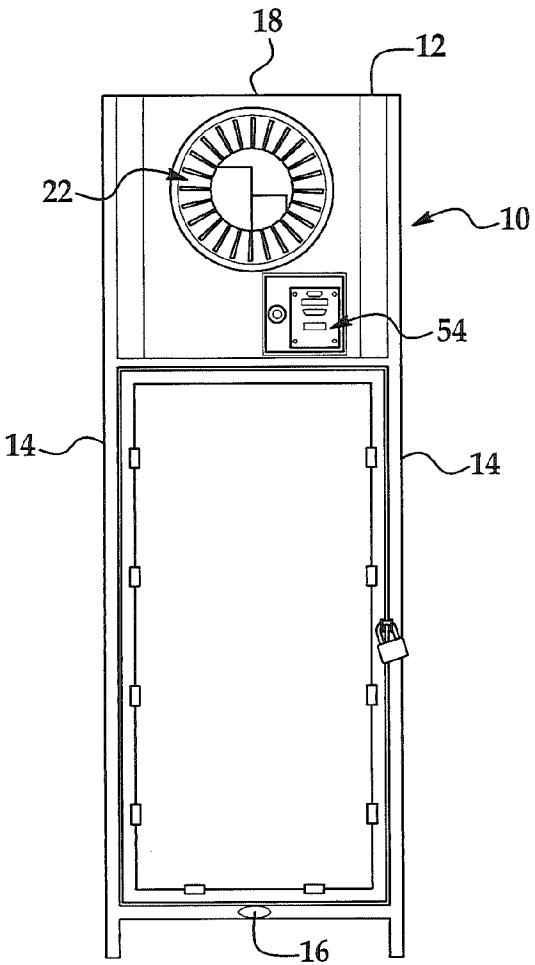
Figure 2:
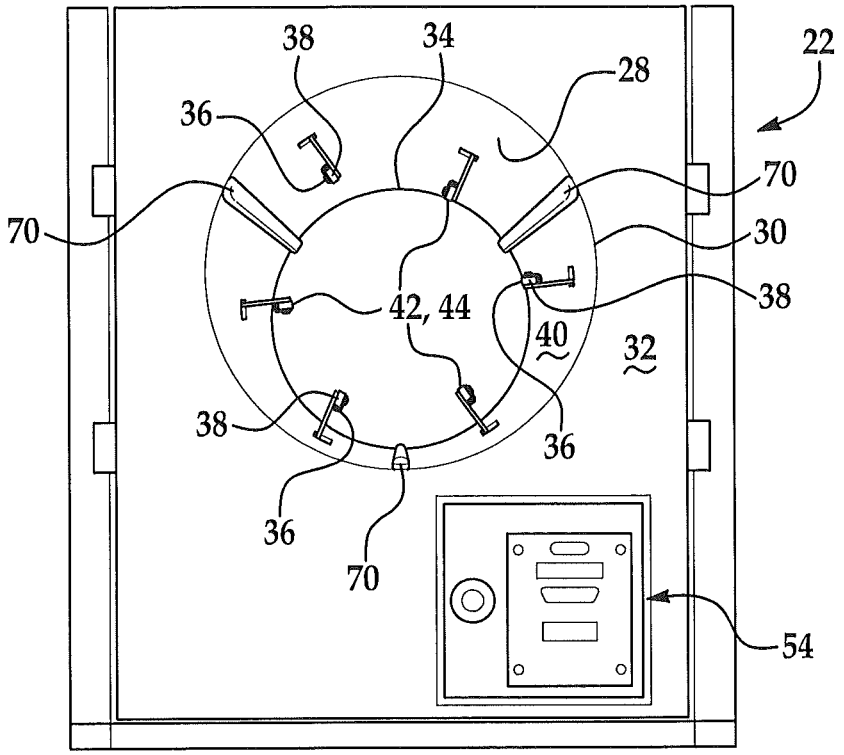
FIGS. 2-7A illustrate a bottle return mechanism of an exemplary embodiment of the present invention for use with the bottle return apparatus illustrated in FIG. 1.
Figure 3:
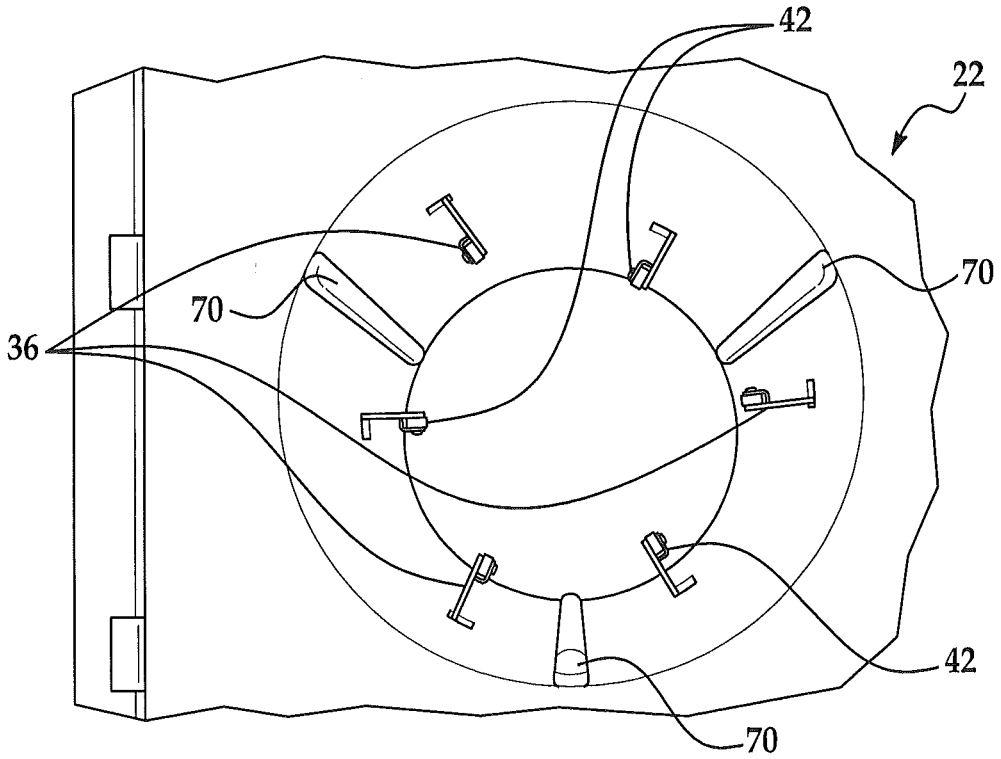

As illustrated in FIGS. 1 and 1A, the apparatus may be an enclosure (FIG. 1) or a combo enclosure and dispensing rack for new filled water bottles (FIG. 1A). In accordance with various exemplary embodiments of the present invention, the enclosure or combo enclosure is configured to be positioned at a retail store wherein purchasers may obtain filled bottles while simultaneously returning empty water bottles for subsequent use. In addition, portions or sidewalls of the enclosure can be configured for printing or advertisements to be disposed thereon such that the enclosure or combo enclosure can be positioned proximate to an entrance of a retail store. Accordingly, consumers can arrive at the store with their empty water bottles insert them in the return mechanism and receive a receipt while also viewing associated advertisements positioned on the enclosure. Still further and when other consumers are exiting the retail store, the enclosure or combo bin can be positioned at the exit such that these consumers may view the advertisements positioned on the enclosure or combo bin.

Typically, retail outlets or stores will charge a deposit fee for the bottle when the purchaser is buying a filled water bottle such that the vendor can be ensured that they are made whole should the consumer fail to return the empty water bottle. This will also promote recycling. It is the return of this empty water bottle that exemplary embodiments of the present invention are contemplated for use therewith. As mentioned above, a deposit is usually taken if the consumer does not return an empty water bottle when they are subsequently purchasing a filled water bottle. As will be discussed herein, the bottle return mechanism of exemplary embodiments of the present invention allows users to return empty water bottles and obtain a receipt for use in a subsequent purchase of a filled water bottle such that they are not charged the typical deposit fee.

Various embodiments of the present invention will allow consumers to arrive at a retail store or outlet and return the empty water bottles without the assistance of an employee of the store and receive a receipt for use in a subsequent transaction.

Figure 10:
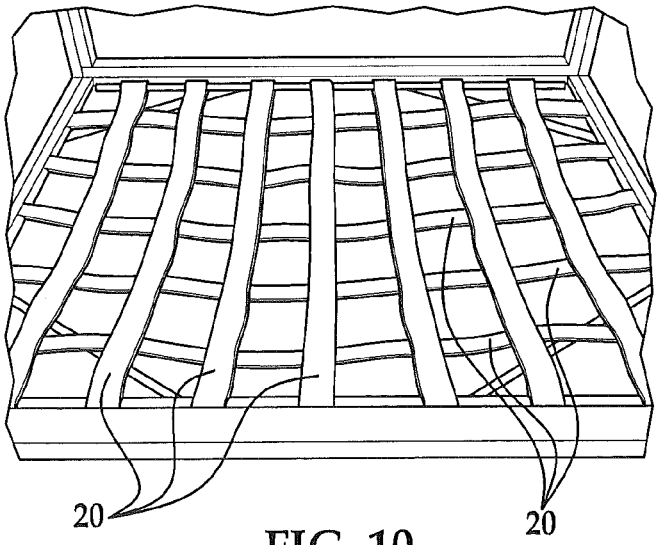
FIG. 10 is a view of a portion of a bottle return apparatus in accordance with an embodiment of the present invention.

In one embodiment, the bottom portion of the enclosure is constructed out of material that will prevent damage to the bottles as they are inserted into the enclosure. For example and in one non-limiting embodiment, the bottom portion is formed from a plurality of canvas or nylon straps 20 arranged in an interlocking fashion (FIG. 10).

As illustrated, the bottle return apparatus includes a bottle return mechanism 22 for determining when a bottle 24 has been received within an interior cavity 26 of the enclosure. In one non-limiting embodiment, the bottle return mechanism has an elongated cylinder 28 that provides a passage into the interior cavity of the enclosure. The elongated cylinder has an inlet opening 30 proximate to an exterior 32 of the enclosure and an outlet opening 34 proximate to the interior cavity. The outlet opening 34 of the elongated cylinder 28 is positioned within the interior cavity 26 of the enclosure such that a bottle passing therethrough can be received within the interior cavity 26.

In order to detect when a bottle has been inserted into the enclosure through the bottle return apparatus a first plurality of actuating arms 36 are located within the passage. The first plurality of actuating arms are pivotally secured to the elongated cylinder for movement between a first position (see at least FIGS. 2, 3, 4 and 6) wherein a distal end 38 of each of the plurality of actuating arms is positioned away from a surface 40 of the elongated cylinder and a second position (see at least FIGS. 5 and 7) wherein the distal end of each of the plurality of actuating arms is moved towards the surface of the elongated cylinder. The first plurality of actuating arms and the elongated cylinder are configured such that when the first plurality of actuating arms are in the first position the water bottle must make contact with the first plurality of actuating arms and move them towards the second position such that the water bottle may travel inwardly into the enclosure. In other words, the first position will not allow the water bottle travel into the enclosure however, the second position will allow the water bottle to travel into the enclosure.

In addition, a second plurality of actuating arms 42 are also located in the passage however, the second plurality of actuating arms are positioned further away from the inlet opening than the first plurality of actuating arms. Similarly to the first plurality of actuating arms, the second plurality of actuating arms are configured such that when the second plurality of actuating arms are in the first position the water bottle must make contact with the second plurality of actuating arms and move them towards the second position such that the water bottle may travel inwardly into the enclosure. In other words, the first position will not allow the water bottle travel into the enclosure however, the second position will allow the water bottle to travel into the enclosure.

Similar to the first plurality of actuating arms, the second plurality of actuating arms are also pivotally secured to the elongated cylinder for movement between a first position (see at least FIGS. 2, 3, 4 and 6) wherein a distal end 44 of each of the plurality of actuating arms is positioned away from the surface of the elongated cylinder and a second position (see at least FIGS. 5 and 7) wherein the distal end of each of the plurality of actuating arms is moved towards the surface of the elongated cylinder.

In one non-limiting exemplary embodiment, each of the plurality of actuating arms (first and second) and the elongated cylinder are configured such that as a predetermined sized water bottle is inserted into the elongated opening in a first direction (e.g., from the inlet opening towards the interior cavity) the distal ends of the actuating arms will contact the water bottle and be moved towards the second position.

Each of the plurality of actuating arms are pivotally secured to the elongated cylinder and are spring biased into the first position by a spring 45 or other equivalent device such that as the predetermined sized water bottle pass therethrough and into the cavity of the enclosure (e.g., through the elongated opening) each of the plurality of actuating arms will be moved towards the second position. The actuating arms will return back to the first position due to the spring biasing force. Moreover, and to prevent a bottle from being removed from the bottle return mechanism after it has been inserted therein at least one of or all of the first plurality of actuating arms are configured such that they cannot be moved from the first position towards the inlet opening. In other words, the first plurality of actuating arms are configured for movement in a first direction namely, from the first position towards outlet opening 34 as well as the surface 40 of the elongated cylinder thereafter the plurality of actuating arms are spring biased back into the first position after the bottle has been received in the cavity however, movement from the first position towards the inlet opening 30 is prevented.

Similarly, and if necessary, the second plurality of actuating arms are also configured for the same type of movement namely from the first position towards the outlet opening 34 and the surface 40 of the elongated cylinder and thereafter back to the first position however, movement from the first position towards the inlet opening which would allow a water bottle to be extracted from the bottle return mechanism is prevented.

Figure 4:
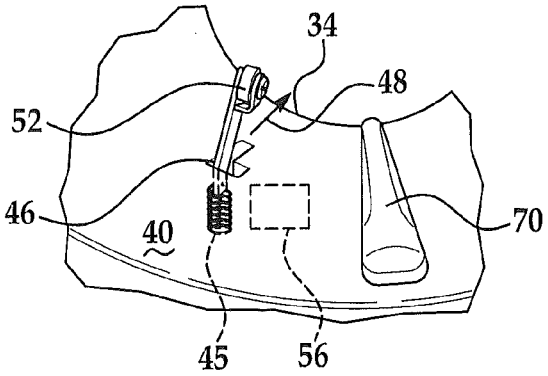
Figure 5:
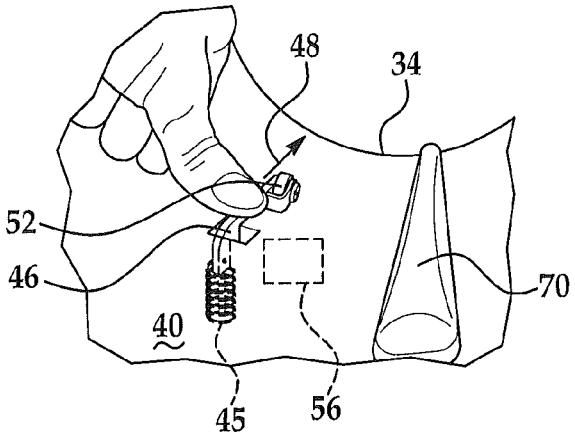

The movement of the actuating arms from the first position towards the outlet opening 34 and the prevention of the movement of the actuating arms from the first position towards the inlet opening 30 is achieved through a slot or opening 46 in the surface of the elongated cylinder. For example, FIG. 4 illustrates one of the first plurality of actuating arms in the first position and FIG. 5 illustrates movement of this actuating arm in the direction of the arrow 48 towards the outlet opening 34 or the second position. Of course, numerous other configurations are contemplated to be within the scope of exemplary embodiments of the present invention.

Since each of the plurality of arms are pivotally secured to the elongated cylinder for movement between a first position and a second position sensing of their movement is desirable to determine when and if a proper sized water bottle has been inserted into the interior cavity by passing through the elongated cylinder.

Figure 6:
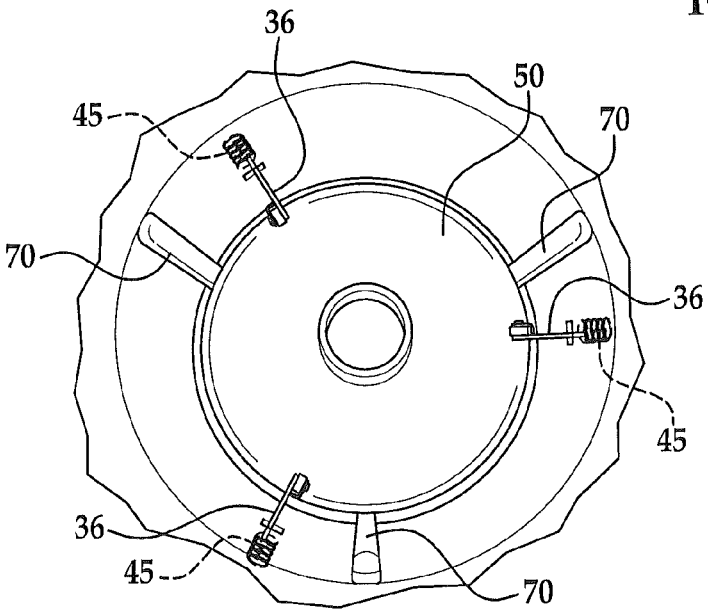
Figure 7:
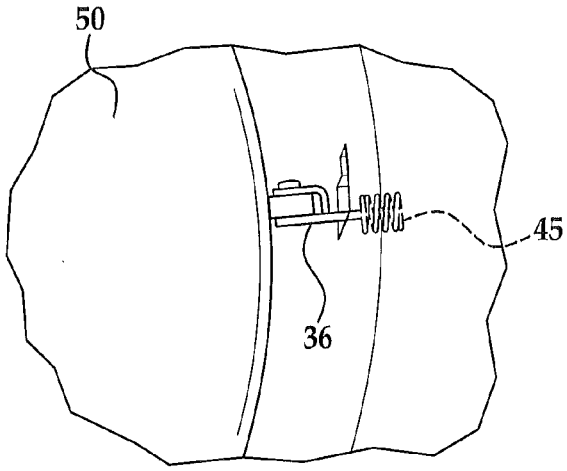

FIG. 6 illustrates an empty water bottle 50 inserted into the bottle return mechanism wherein the empty water bottle has been inserted past the first plurality of actuating arms 36 each of which has now sprung back to the first position. Accordingly and when these actuating arms are in the first position the removal of the empty water bottle 50 from the elongated cylinder is prevented. FIG. 7 illustrates an exterior surface of the empty water bottle contacting a distal end of one of the plurality of actuating arms after it has been moved towards the surface of the elongated cylinder.

In one non-limiting exemplary embodiment and in order to facilitate movement of the empty water bottle into the bottle return mechanism each of the distal ends of the plurality of actuating arms has a ball bearing 52 rotatably secured thereto. Of course, other equivalent structures may replace ball bearing 52 to provide a means for facilitating the movement of the empty water bottle pass the actuating arm. In addition and in one non-limiting embodiment, the first plurality of actuating arms are located a first distance from the inlet opening while the second plurality of actuating arms are located a second distance from the inlet opening, wherein the second distance is greater than the first distance.

Moreover and in order to give a user a receipt when they have deposited an empty bottle into the bottle return mechanism another mechanism 54 is coupled to or comprises a portion of the bottle return mechanism. This mechanism is configured to provide an output (e.g., a coupon or receipt) when the first plurality of actuating arms and the second plurality of actuating arms have been simultaneously moved to the second position and thereafter back to the first position thus indicating that an empty bottle has been properly received within the bottle return apparatus. One non-limiting example of mechanism 54 is a receipt dispenser or printer configured to generate a receipt with indicia or other encoded information readable at another location such that the receipt may be used in conjunction with another transaction (e.g., purchase of another filled water bottle) wherein the cost or deposit fee is not charged because the user has supplied a receipt indicating that they have returned an empty water bottle. In an alternative embodiment, the mechanism may be coupled (e.g., electrically, wirelessly, etc.) to the cash register system of the retail store such that an indication of a returned water bottle or water bottles is provided to the register at the checkout counter of the retail store.

In order to provide this output at least one or all or any combination of the first plurality of actuating arms are coupled to or proximate to a sensor 56 that provides a signal indicative of the position of the actuating arm. In one non-limiting exemplary embodiment, each of the plurality of actuating arms are pivotally secured to the elongated cylinder or a portion of the enclosure such that as they move from the first position to a second position another portion of the arm is displaceable with respect to a sensor which can determine the location of the arm (e.g., first position or second position).

Accordingly and as the actuating arm is moved from the first position to the second position, the sensor will detect this movement and provide a first signal. Thereafter and as the bottle passes through the actuating arm will move back to the second position and the sensor will provide a second signal. The first signal and the second signal will be received by a microprocessor or other equivalent device coupled to the sensors of the actuating arms.

In addition, at least one or all or any combination of the second plurality of actuating arms are also coupled to or proximate to a sensor 57 that provides a signal indicative of the position of the actuating arm. Accordingly and as the actuating arm of the second plurality of arms is moved from the first position to the second position, the sensor will detect this movement and provide a corresponding first signal. Thereafter and as the bottle passes by the actuating arms of the second plurality of actuating arms the arms will move back to the first position and a corresponding second signal will be received.

In one embodiment and in order to determine when a bottle has been properly received by the bottle return mechanism the mechanism 54 must receive corresponding signals from the associated sensors of the first plurality of actuators and the second plurality of actuators. Furthermore and in one embodiment, the mechanism must receive a corresponding first signal from at least one of the first plurality of actuators and at least one of the second plurality of actuators simultaneously. In this embodiment, the first plurality of arms and the second plurality of arms are configured to each the manipulated into the second position as the empty water bottle is inserted through elongated cylinder. The receipt of these two signals simultaneously will indicate that the actuating arms of both the first plurality of arms and the second plurality of arms have been manipulated thereto by the empty bottle. This ensures that a properly sized bottle has been inserted into the bottle return mechanism since the first plurality of actuating arms are closer to the inlet opening than the second plurality of actuating arms or in other words, the first plurality of actuating arms are offset from the second plurality of actuating arms. In other words, the location of the first plurality of arms and the second plurality of arms are positioned such that as a predetermined size water bottle is inserted therein at one point both the first plurality of arms and the second plurality of arms will have been moved from the first position to the second position. Alternatively, the return mechanism can be configured to have the first plurality of arms moved from the first position to the second position and thereafter the second plurality of arms moved from the first position to the second position depending on the size location and configuration of the plurality of arms as well as the water bottle being returned.

Thereafter and as the bottle is pushed all the way through the elongated cylinder the first plurality of actuating arms and the second plurality of actuating arms will spring back to the first position and a corresponding signal will also be received and supplied to the mechanism. Once the mechanism receives this second signal it now can determine that an empty bottle has been inserted into the bottle return mechanism and a coupon or receipt will be generated by the mechanism. The coupon or receipt is then used by the consumer when the purchase another filled water bottle.

In an alternative exemplary embodiment, the microprocessor may be configured to first receive a signal from the first plurality of arms as they are moved from the first position to the second position and then receive a subsequent signal from the second plurality of arms as they are moved from the first position to the second position and thereafter require receipt of the signal indicating that both the first plurality of arms and the second plurality of arms are at the first position. Of course, other variations are considered to be within the scope of exemplary embodiments the present invention.

Figure 7A:
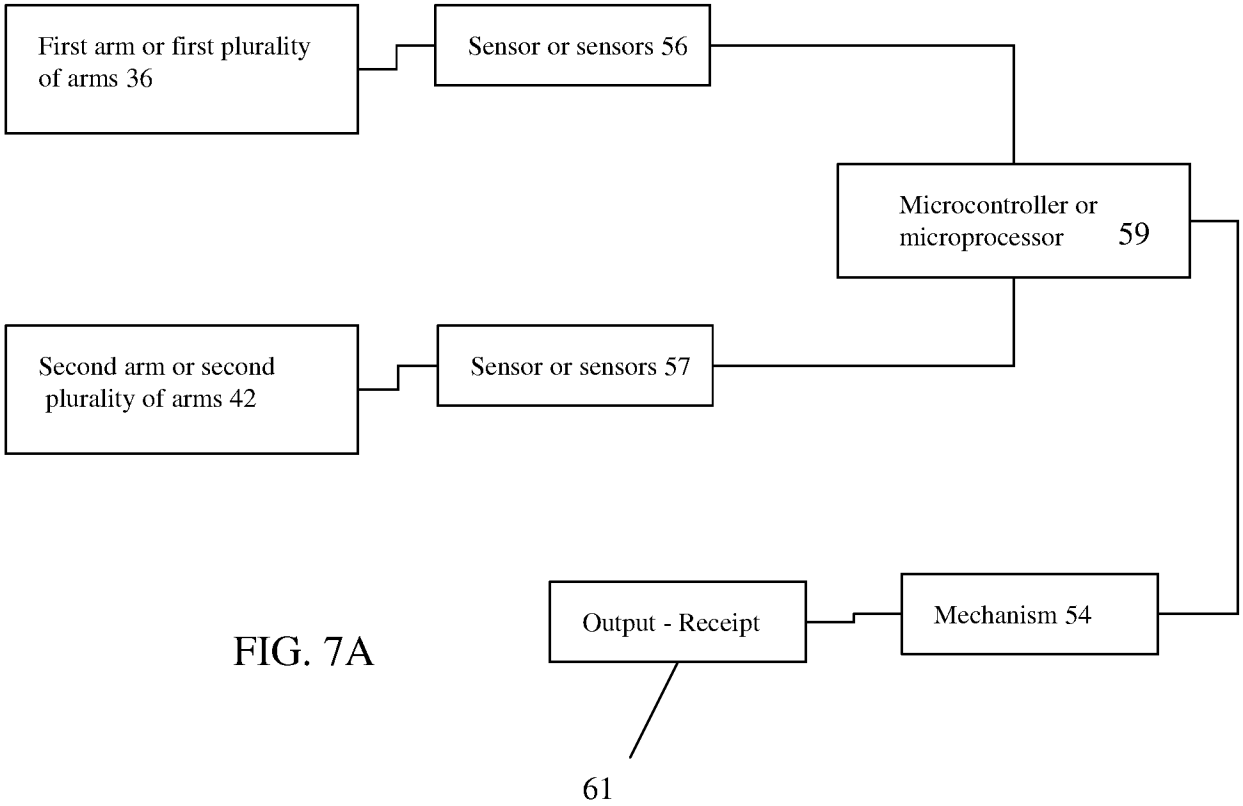

One non-limiting schematic of this system is illustrated schematically in FIG. 7A. As previously described, each one of the first plurality of arms 36 or at least one of the first plurality of arms 36 is or has a portion located proximate to a sensor 56 configured to detect movement of the arm or arms 36 from the first position to the second position and back to the first position. Similarly each one of the second plurality of arms 42 or at least one of the plurality of arms 42 is or has a portion located proximate to a sensor 57 configured to detect movement of the arm or arms 42 from the first position to the second position and back to the first position. Each one of the sensors (56, 57) is coupled to a microcontroller or microprocessor 59 configured to have logic or software configured to interpret signals generated by sensors 56 and 57.

In one exemplary embodiment, the signals of the sensors are inputted into a control algorithm resident upon the microprocessor or microcontroller 59 in order to determine a predetermined event has occurred (e.g., placement of the empty water bottle into and through the elongated cylinder such that the empty water bottle is now received within the receiving cavity of the bottle return mechanism).

As previously described, the operational protocol of microcontroller or microprocessor 59 is configured to provide an output signal to mechanism 54 when a predetermined event has occurred namely, movement of at least one or all or any combination of the first plurality of arms from the first position to the second position and movement of at least one or all or any combination of the second plurality of arms from the first position to the second position and wherein the first plurality of arms and the second plurality of arms are located in the second position at the same time such that the microcontroller microprocessor 59 receive signals from both sensors 56 and 57 to indicate that the correct size bottle has been inserted into the return mechanism. Thereafter, and as the arms 36 and 42 pivot back to the first position yet another signal is sent to the microprocessor to indicate that the bottle has been completely inserted into the receiving area of the return mechanism. Once this event has occurred, the microprocessor will send a signal to mechanism 54 which instructs it to provide an output or receipt 61.

As is known to one skilled in the related arts sensors 56 and 57 may comprise any suitable sensor configured to detect movement of a portion of arms 36 and 42, non-limiting examples include Hall effect sensors, optical sensors, etc., mechanical sensors, switches, equivalents thereof as well as combination thereof.

Still further and as known to those skilled in the related arts, mechanism 54 can comprise any mechanism capable of providing an output that the user can take from the bottle return apparatus and use towards a subsequent repurchase as discussed above wherein the purchase of the filled water bottle does not include a deposit fee for the empty water bottle. Non-limiting examples include, printed paper, tokens, magnetic cards, etc. and equivalents thereof.

In one embodiment of the present invention, the surface of the elongated cylinder also has a plurality of guide rails 70 that are configured to assist in the insertion of the water bottle into the bottle return mechanism. As illustrated, the guide rail 70 are longitudinally arranged such that frictional forces between the elongated cylinder and the empty water bottle are reduced.

Figure 8:
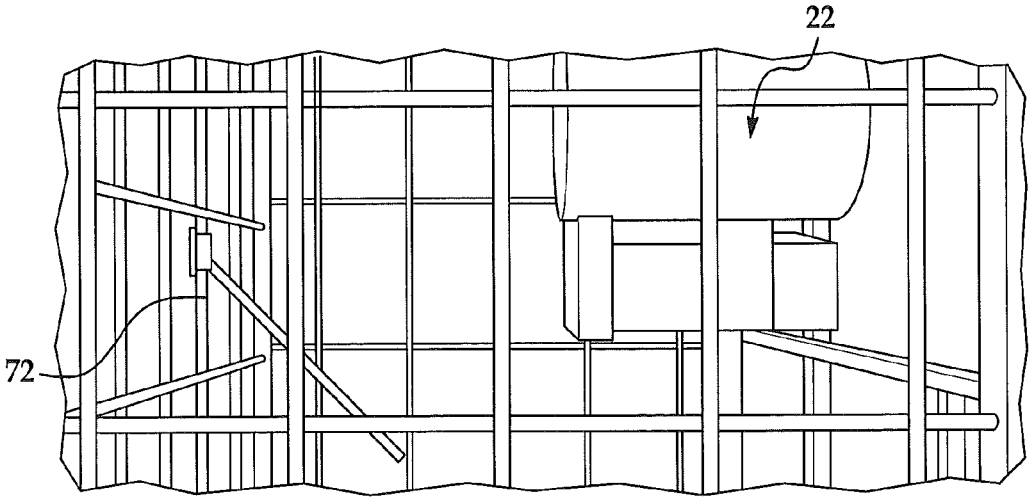
FIG. 8 is a view of a portion of a bottle return apparatus in accordance with an embodiment of the present invention.
Figure 9A:
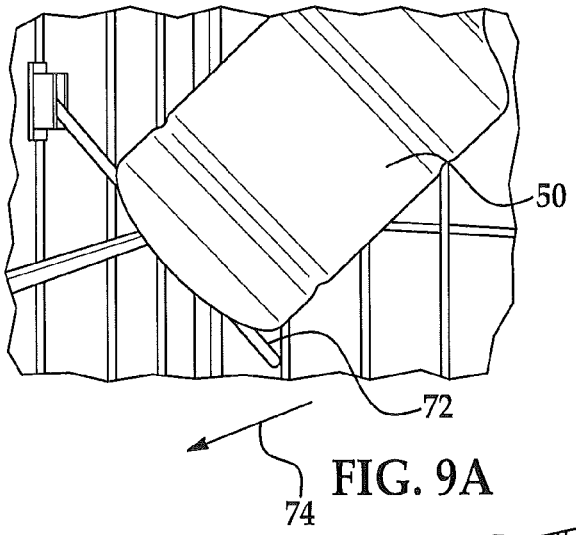
FIGS. 9A and 9B illustrate a bottle dropping into the bottle return apparatus of an exemplary embodiment of the present invention.
Figure 9B:
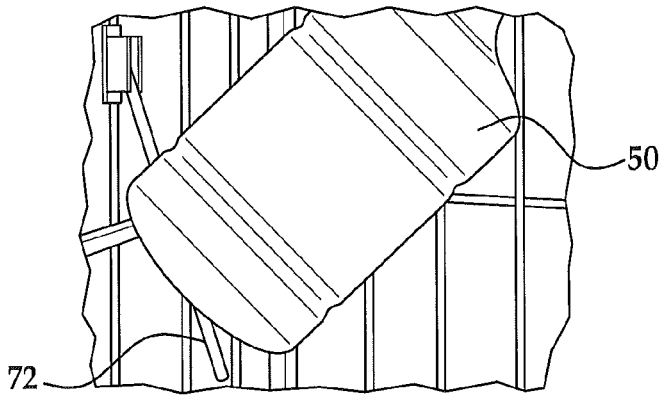

In still another alternative exemplary embodiment and in order to prevent damage to the empty water bottles as they are dropped into the receiving area or to slow the dropping of the bottle into the receiving area of the enclosure as it exits the outlet opening of the bottle return mechanism, a buffering bar 72 is pivotally secured to a wall of the enclosure. As illustrated in FIGS. 8, 9A and 9B, the buffering bar is spring biased into a first position FIG. 8 and then as the bottle exits the bottle return mechanism the bottle contacts the buffering bar (FIG. 9A) and pushes it downwardly in the direction of arrow 74 against the spring biasing force of the buffering bar in order to slow the dropping force of velocity of the bottle such that the force of the impacts of the bottle against the bottom surface of the enclosure are minimized. Accordingly, the buffering bar is located such that the bottle has to be buffered by the buffering bar before is hits the bottom of the enclosure of other bottles in the enclosure.

In addition and as discussed above, the bottom portion of the enclosure is constructed out of material that will also prevent damage to the bottles as they are inserted into the enclosure. For example and in one non-limiting embodiment, the bottom portion is formed from a plurality of canvas or nylon straps 20 arranged in an interlocking fashion (See at least FIG. 10).

Figure 11B:
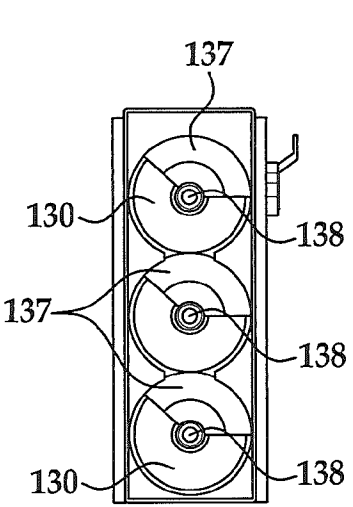
FIGS. 11-11E illustrate an alternative exemplary embodiment of the present invention.
Figure 11E:
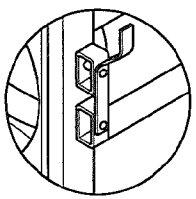
Figure 11A:
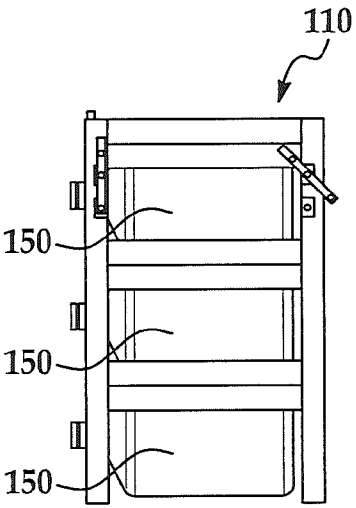
Figure 11D:
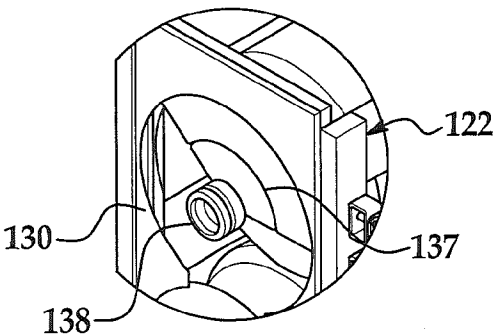
Figure 11:
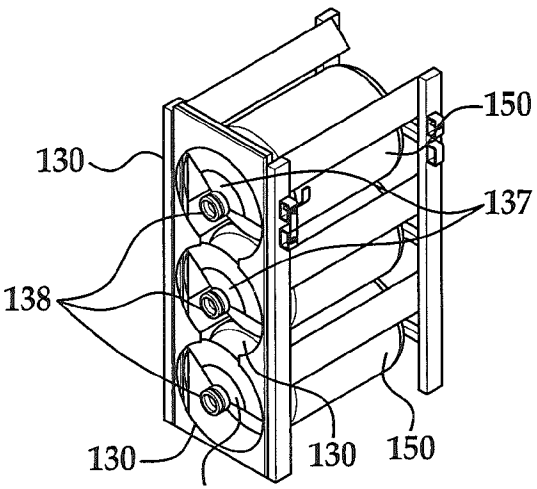
Figure 11C:
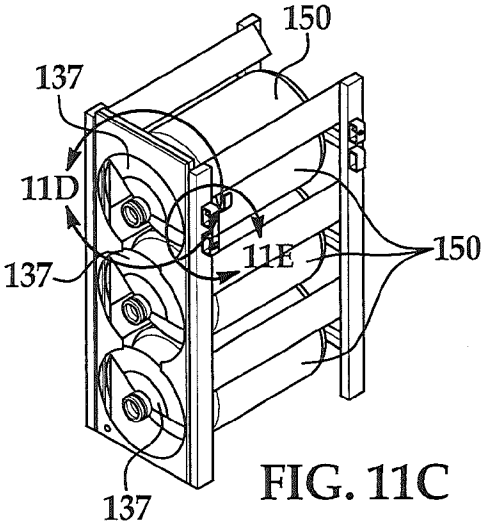

Referring now to FIGS. 11-11E an alternative exemplary embodiment is illustrated. Here an apparatus 110 for receiving recyclable product such as a water bottle 150 is illustrated.

In this embodiment, the apparatus is configured such that lower access points for bottle recycling are provided. This is particularly advantageous for elderly, disabled or other consumers who cannot lift the empty water bottle to the elevated bottle return mechanism illustrated in FIGS. 1-10.

In this embodiment, an enclosed structure 112 of the apparatus defines a cavity for receipt of the bottle therein. Apparatus 110 has a bottle return mechanism 122 for receiving and engaging a bottle when it has been inserted into the apparatus. The apparatus provides a passage having an inlet opening 130 proximate to an exterior of the enclosed structure and an outlet opening 134 proximate to another exterior surface of the enclosure. A flexible member 137 is located proximate to the inlet opening. The flexible member is configured to be deflected inwardly towards a surface of the passage a first position wherein a distal end 138 of the flexible member is positioned in the inlet opening. The flexible member is constructed out of a resilient material such as plastic or metal, wherein the flexible member is biased towards the first position and is configured to cover a portion of the inlet opening when it is in the first position such that the distal end of the flexible member will prevent a bottle that is completely inserted into the passage through the inlet opening in a first direction from being subsequently removed from the passage in a direction opposite to the first direction. In other words, the flexible member is configured to be deflected inwardly into the inlet opening but not outwardly such that once bottle is inserted therein the bottle cannot be removed from the receiving end of the enclosure.

Other apparatus for receipt of returnable items are illustrated in U.S. Pat. Nos. 5,161,661; 5,355,987; 6,575,290; and 6,817,462 the contents each of which are incorporated herein by reference thereto and U.S. Patent Publication No. U.S. 2008/0134735 illustrates an apparatus and method for vending securely stored products to consumers, the contents of which are incorporated herein by reference thereto.

While the invention has been described with reference to one or more exemplary embodiments, it will be understood by those skilled in the art that various changes may be made, the various steps may be accomplished in different ways, and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. An apparatus for receiving recyclable product, comprising:

an enclosed structure defining an interior cavity;

a bottle return mechanism for determining when a bottle has been received within the interior cavity, comprising:

an elongated cylinder providing a passage into the interior cavity, the elongated cylinder having an inlet opening proximate to an exterior of the enclosed structure and an outlet opening proximate to the interior cavity;

a first plurality of actuating arms located in the passage, wherein the first plurality of actuating arms are pivotally secured to the elongated cylinder for movement between a first position wherein a distal end of each of the plurality of actuating arms is positioned away from a surface of the elongated cylinder and a second position wherein the distal end of each of the plurality of actuating arms is moved towards the surface of the elongated cylinder, the first plurality of actuating arms being located a first distance from the inlet opening; and a second plurality of actuating arms located in the passage, wherein the second plurality of actuating arms are pivotally secured to the elongated cylinder for movement between a first position wherein a distal end of each of the plurality of actuating arms is positioned away from a surface of the elongated cylinder and a second position wherein the distal end of each of the plurality of actuating arms is moved towards the surface of the elongated cylinder, the second plurality of actuating arms being located a second distance from the inlet opening, the second distance being greater than the first distance; and a mechanism coupled to be bottle return mechanism, the mechanism being configured to provide an output when the first plurality of actuating arms and the second plurality of actuating arms have been simultaneously moved to the second position and thereafter back to the first position.

2. The apparatus as in claim 1, wherein each of the first plurality of actuating arms and each of the second plurality of actuating arms are spring biased into the first position and wherein the bottle is a 5 gallon or 3 gallon water bottle.

3. The apparatus as in claim 1, wherein each of the first plurality of actuating arms and each of the second plurality of actuating arms further comprise a ball bearing rotatably secured proximate to the distal end.

4. The apparatus as in claim 1, wherein each of the first plurality of actuating arms and each of the second plurality of actuating arms are received within a slotted opening in the surface of the elongated cylinder.

5. The apparatus as in claim 4, wherein the slotted opening defines a limit of travel of each of the first plurality of actuating arms and each of the second plurality of actuating arms as they are moved towards the first position and wherein the bottle is a 5 gallon or 3 gallon water bottle.

6. The apparatus as in claim 1, wherein the surface of the elongated opening further comprises a plurality of guide rails for guiding the bottle therein and wherein the bottle is a 5 gallon or 3 gallon water bottle.

7. The apparatus as in claim 1, wherein each of the first plurality of actuating arms and each of the second plurality of actuating arms are located proximate to a sensor that will provide a signal indicative of the position of the actuating arm relative to the surface of the elongated cylinder.

8. The apparatus as in claim 1, wherein the output of the mechanism is a receipt.

9. The apparatus as in claim 1, wherein a bottom portion of the enclosed structure is formed from a plurality of straps arranged in an interlocking fashion.

10. The apparatus as in claim 1, further comprising a buffering bar pivotally secured to a portion of the enclosure, wherein the buffering bar is located proximate to the outlet opening of the elongated cylinder such that a bottle exiting therefrom contacts the buffering bar in order to slow down a dropping velocity of the bottle.

11. The apparatus as in claim 1, wherein the bottle is a 5 gallon water bottle.

12. The apparatus as in claim 1, wherein each of the first plurality of actuating arms and each of the second plurality of actuating arms are spring biased into the first position and wherein each of the first plurality of actuating arms and each of the second plurality of actuating arms further comprise a ball bearing rotatably secured proximate to the distal end.

13. The apparatus as in claim 1, wherein each of the first plurality of actuating arms and each of the second plurality of actuating arms are spring biased into the first position and wherein each of the first plurality of actuating arms and each of the second plurality of actuating arms are located proximate to a sensor that will provide a signal indicative of the position of the actuating arm relative to the surface of the elongated cylinder.

14. The apparatus as in claim 13, wherein the output of the mechanism is only provided when the sensor of at least one of the first plurality of actuating arms and the sensor at least one of the second plurality of actuating arms indicates that the at least one of the first plurality of actuating arms and the at least one of the second plurality of actuating arms are simultaneously positioned in the second position.

15. The apparatus as in claim 14, wherein the output of the mechanism is a receipt.

16. The apparatus as in claim 14, wherein each of the first plurality of actuating arms and each of the second plurality of actuating arms are received within a slotted opening in the surface of the elongated cylinder and wherein the slotted opening defines a limit of travel of each of the first plurality of actuating arms and each of the second plurality of actuating arms as they are moved towards the first position and wherein the bottle is a 5 gallon water bottle and wherein each of the first plurality of actuating arms are configured such that once the bottle has travelled past the actuating arms and they return to the first position, the bottle cannot be removed from the elongated cylinder through the inlet opening.

17. The apparatus as in claim 1, wherein a dispensing rack is secured to the enclosed structure and wherein the water bottle is a 5 gallon or 3 gallon water bottle and the dispensing rack further comprises a plurality of shelves each being spaced to receive and support a plurality of water bottles.

18. The apparatus as in claim 17, wherein a width of the shelves is substantially similar to a width of the enclosure.

* * * * *